US011138944B2

(12) United States Patent
Huang et al.

(10) Patent No.: US 11,138,944 B2
(45) Date of Patent: Oct. 5, 2021

(54) PIXEL MATRIX DRIVING DEVICE AND DISPLAY DEVICE

(71) Applicant: Xianyang Caihong Optoelectronics Technology Co., Ltd, Xianyang (CN)

(72) Inventors: Yusheng Huang, Xianyang (CN); Yuyeh Chen, Xianyang (CN); Yuan-Liang Wu, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 0 days.

(21) Appl. No.: 16/701,441

(22) Filed: Dec. 3, 2019

(65) Prior Publication Data

US 2020/0184913 A1 Jun. 11, 2020

(30) Foreign Application Priority Data

Dec. 6, 2018 (CN) ..... 201811488784.1
Jan. 29, 2019 (CN) ..... 201910086860.4

(51) Int. Cl.
*G09G 3/36* (2006.01)

(52) U.S. Cl.
CPC ..... *G09G 3/3607* (2013.01); *G09G 3/3614* (2013.01); *G09G 3/3674* (2013.01); *G09G 3/3685* (2013.01); *G09G 2310/08* (2013.01); *G09G 2320/0223* (2013.01)

(58) Field of Classification Search
CPC . G09G 3/3514; G09G 3/3607; G09G 2310/08
See application file for complete search history.

(56) References Cited

U.S. PATENT DOCUMENTS 6,172,662 B1 * 1/2001 Ito ..... G09G 3/3625 345/94
6,243,062 B1 * 6/2001 den Boer ..... G09G 3/367 345/91
9,697,783 B2 * 7/2017 Yeo ..... G09G 3/3614
2006/0152464 A1 * 7/2006 Ishii ..... G09G 3/3648 345/98
2007/0262941 A1 * 11/2007 Jan ..... G09G 3/3614 345/96

(Continued)

*Primary Examiner* — Carolyn R Edwards
*Assistant Examiner* — Bipin Gyawali
(74) *Attorney, Agent, or Firm* — WPAT, PC

(57) ABSTRACT

A pixel matrix driving device and a display device are provided. The pixel matrix driving device includes a pixel matrix, a timing controller and a driving circuit. The pixel matrix includes a plurality of sub-pixels, an i-th column of sub-pixels in the plurality of sub-pixels and an (i+1)-th column of sub-pixels in the plurality of sub-pixels have different polarity inversion positions. The timing controller is configured for obtaining an initial pixel value, and obtaining a first grayscale value and a second grayscale value according to the initial pixel value. The driving circuit is configured for obtaining a first driving voltage according to the first grayscale value, obtaining a second driving voltage according to the second grayscale value, and applying the first driving voltage and the second driving voltage into the pixel matrix. The disclosure can improve the horizontal equidistant horizontal stripes and improve the washout phenomenon of the display panel.

5 Claims, 9 Drawing Sheets

| | D1 | D2 | D3 | D4 | D5 | D6 | D7 | D8 | D9 | D10 | D11 | D12 | D13 | D14 | D15 |
|---|---|---|---|---|---|---|---|---|---|---|---|---|---|---|---|
| G1 | + | − | − | + | + | − | − | + | + | − | − | + | + | − | − |
| G2 | + | − | − | + | + | − | − | + | + | − | − | + | + | − | − |
| G3 | + | − | − | + | + | − | − | + | + | − | − | + | + | − | − |
| G4 | − | − | + | + | + | − | − | + | + | − | − | + | − | − | + |
| G5 | − | − | + | + | + | − | − | + | − | − | − | + | − | − | + |
| G6 | − | − | + | + | + | − | − | + | − | − | + | + | − | − | + |
| G7 | − | − | + | + | + | + | − | − | − | − | + | + | − | − | + |
| G8 | − | − | + | + | + | + | − | − | − | − | + | + | − | − | + |
| G9 | − | − | + | + | + | + | − | − | − | − | + | + | − | − | + |
| G10 | − | − | + | + | − | + | + | − | − | − | + | + | − | − | + |
| G11 | − | − | + | + | − | + | + | − | − | + | + | − | − | − | + |
| G12 | − | − | + | + | − | + | + | − | − | + | + | | − | − | + |
| G13 | − | + | + | − | − | + | + | − | − | + | + | − | − | + | + |
| G14 | − | + | + | − | − | + | + | − | − | + | + | − | − | + | + |
| G15 | − | + | + | − | − | + | + | − | − | + | + | − | − | + | + |
| G16 | + | − | − | + | + | − | − | + | + | − | − | + | + | − | − |

(56) References Cited

U.S. PATENT DOCUMENTS

| | | | | |
|---|---|---|---|---|
| 2011/0254759 | A1* | 10/2011 | Mori | G09G 3/3607 345/88 |
| 2013/0321253 | A1* | 12/2013 | Park | G09G 3/3614 345/100 |
| 2016/0189641 | A1* | 6/2016 | Son | G09G 3/3607 345/205 |
| 2019/0189069 | A1* | 6/2019 | Huang | G09G 3/3614 |
| 2019/0206341 | A1* | 7/2019 | Liao | G09G 3/3611 |
| 2020/0135137 | A1* | 4/2020 | Kim | G09G 3/3696 |

* cited by examiner

| | D1 | D2 | D3 | D4 | D5 | D6 | D7 | D8 | D9 | D10 | D11 | D12 | D13 | D14 | D15 | D16 | D17 | D18 | D19 | D20 |
|---|---|---|---|---|---|---|---|---|---|---|---|---|---|---|---|---|---|---|---|---|
| G1 | + | - | - | + | + | - | - | + | + | - | - | + | + | - | - | + | + | - | - | + |
| G2 | - | - | + | + | + | - | - | + | + | - | - | + | + | - | - | + | - | - | + | + |
| G3 | - | - | + | + | + | - | - | + | + | - | - | + | + | - | - | + | - | - | + | + |
| G4 | - | - | + | + | + | - | - | + | - | - | + | + | + | - | - | + | - | - | + | + |
| G5 | - | - | + | + | + | - | - | + | - | - | + | + | + | - | - | + | - | - | + | + |
| G6 | - | - | + | + | - | - | + | + | - | - | + | + | + | - | - | + | - | - | + | + |
| G7 | - | - | + | + | - | - | + | + | - | - | + | + | + | - | - | + | - | - | + | + |
| G8 | - | - | + | + | - | - | + | + | - | - | + | + | - | - | + | + | - | - | + | + |
| G9 | - | + | + | - | - | - | + | + | - | - | + | + | - | - | + | + | - | + | + | - |
| G10 | - | + | + | - | - | - | + | + | - | - | + | + | - | - | + | + | - | + | + | - |
| G11 | - | + | + | - | - | - | + | + | - | + | + | - | - | - | + | + | - | + | + | - |
| G12 | - | + | + | - | - | - | + | + | - | + | + | - | - | - | + | + | - | + | + | - |
| G13 | - | + | + | - | - | + | + | - | - | + | + | - | - | - | + | + | - | + | + | - |
| G14 | - | + | + | - | - | + | + | - | - | + | + | - | - | - | + | + | - | + | + | - |
| G15 | - | + | + | - | - | + | + | - | - | + | + | - | - | + | + | - | - | + | + | - |
| G16 | - | + | + | - | - | + | + | - | - | + | + | - | - | + | + | - | - | + | + | - |
| G17 | - | + | + | - | - | + | + | - | - | + | + | - | - | + | + | - | - | + | + | - |
| G18 | + | + | - | - | - | + | + | - | - | + | + | - | - | + | + | - | + | + | - | - |

FIG. 1

| | D1 | D2 | D3 | D4 | D5 | D6 | D7 | D8 | D9 | D10 | D11 | D12 | D13 | D14 | D15 | D16 | D17 | D18 | D19 | D20 |
|---|---|---|---|---|---|---|---|---|---|---|---|---|---|---|---|---|---|---|---|---|
| G1 | H | L | H | L | H | L | H | L | H | L | H | L | H | L | H | L | H | L | H | L |
| G2 | L | H | L | H | L | H | L | H | L | H | L | H | L | H | L | H | L | H | L | H |
| G3 | H | L | H | L | H | L | H | L | H | L | H | L | H | L | H | L | H | L | H | L |
| G4 | L | H | L | H | L | H | L | H | L | H | L | H | L | H | L | H | L | H | L | H |
| G5 | H | L | H | L | H | L | H | L | H | L | H | L | H | L | H | L | H | L | H | L |
| G6 | L | H | L | H | L | H | L | H | L | H | L | H | L | H | L | H | L | H | L | H |
| G7 | H | L | H | L | H | L | H | L | H | L | H | L | H | L | H | L | H | L | H | L |
| G8 | L | H | L | H | L | H | L | H | L | H | L | H | L | H | L | H | L | H | L | H |
| G9 | H | L | H | L | H | L | H | L | H | L | H | L | H | L | H | L | H | L | H | L |
| G10 | L | H | L | H | L | H | L | H | L | H | L | H | L | H | L | H | L | H | L | H |
| G11 | H | L | H | L | H | L | H | L | H | L | H | L | H | L | H | L | H | L | H | L |
| G12 | L | H | L | H | L | H | L | H | L | H | L | H | L | H | L | H | L | H | L | H |
| G13 | H | L | H | L | H | L | H | L | H | L | H | L | H | L | H | L | H | L | H | L |
| G14 | L | H | L | H | L | H | L | H | L | H | L | H | L | H | L | H | L | H | L | H |
| G15 | H | L | H | L | H | L | H | L | H | L | H | L | H | L | H | L | H | L | H | L |
| G16 | L | H | L | H | L | H | L | H | L | H | L | H | L | H | L | H | L | H | L | H |
| G17 | H | L | H | L | H | L | H | L | H | L | H | L | H | L | H | L | H | L | H | L |
| G18 | L | H | L | H | L | H | L | H | L | H | L | H | L | H | L | H | L | H | L | H |

FIG. 2

Direction of scan line

Direction of data line

| | D1 | D2 | D3 | D4 | D5 | D6 | D7 | D8 | D9 | D10 | D11 | D12 | D13 | D14 | D15 |
|---|---|---|---|---|---|---|---|---|---|---|---|---|---|---|---|
| G1 | H | L | H | L | H | L | H | L | H | L | H | L | H | L | H |
| G2 | H | L | H | L | H | L | H | L | H | L | H | L | H | L | H |
| G3 | H | L | H | L | H | L | H | L | H | L | H | L | H | L | H |
| G4 | L | H | L | H | L | H | L | H | L | H | L | H | L | H | L |
| G5 | L | H | L | H | L | H | L | H | L | H | L | H | L | H | L |
| G6 | L | H | L | H | L | H | L | H | L | H | L | H | L | H | L |
| G7 | H | L | H | L | H | L | H | L | H | L | H | L | H | L | H |
| G8 | H | L | H | L | H | L | H | L | H | L | H | L | H | L | H |
| G9 | H | L | H | L | H | L | H | L | H | L | H | L | H | L | H |
| G10 | L | H | L | H | L | H | L | H | L | H | L | H | L | H | L |
| G11 | L | H | L | H | L | H | L | H | L | H | L | H | L | H | L |
| G12 | L | H | L | H | L | H | L | H | L | H | L | H | L | H | L |
| G13 | H | L | H | L | H | L | H | L | H | L | H | L | H | L | H |
| G14 | H | L | H | L | H | L | H | L | H | L | H | L | H | L | H |
| G15 | H | L | H | L | H | L | H | L | H | L | H | L | H | L | H |
| G16 | L | H | L | H | L | H | L | H | L | H | L | H | L | H | L |

FIG. 8

| | D1 | D2 | D3 | D4 | D5 | D6 | D7 | D8 | D9 | D10 | D11 | D12 | D13 | D14 | D15 |
|---|---|---|---|---|---|---|---|---|---|---|---|---|---|---|---|
| G1 | + | − | − | + | + | − | − | + | + | − | − | + | + | − | − |
| G2 | + | − | − | + | + | − | − | + | + | − | − | + | + | − | − |
| G3 | + | − | − | + | + | − | − | + | + | − | − | + | + | − | − |
| G4 | − | − | + | + | + | − | − | + | + | − | − | + | − | − | + |
| G5 | − | − | + | + | + | − | − | + | − | − | + | + | − | − | + |
| G6 | − | − | + | + | + | − | − | + | − | − | + | + | − | − | + |
| G7 | − | − | + | + | + | + | − | − | − | − | + | + | − | − | + |
| G8 | − | − | + | + | + | + | − | − | − | − | + | + | − | − | + |
| G9 | − | − | + | + | + | + | − | − | − | − | + | + | − | − | + |
| G10 | − | − | + | + | − | + | + | − | − | − | + | + | − | − | + |
| G11 | − | − | + | + | − | + | + | − | − | + | + | − | − | − | + |
| G12 | − | − | + | + | − | + | + | − | − | + | + | | − | − | + |
| G13 | − | + | + | − | − | + | + | − | − | + | + | − | − | + | + |
| G14 | − | + | + | − | − | + | + | − | − | + | + | − | − | + | + |
| G15 | − | + | + | − | − | + | + | − | − | + | + | − | − | + | + |
| G16 | + | − | − | + | + | − | − | + | + | − | − | + | + | − | − |

FIG. 9

PIXEL MATRIX DRIVING DEVICE AND DISPLAY DEVICE

FIELD OF THE DISCLOSURE

The disclosure relates to a display technology field, and more particularly to a pixel matrix driving device and a display device.

BACKGROUND OF THE DISCLOSURE

With the development of display technology, Liquid Crystal Display (LCD) has gradually replaced the cathode ray tube (CRT) display device due to its advantages of lightness, thinness and low radiation. It is the most common display device in information terminals such as computers, smart phones, mobile phones, car navigation devices, and e-books.

As the display specifications of liquid crystal displays continue to develop toward large sizes, the market demands more and more attention to high contrast, rapid response, and wide viewing angles for the performance requirements of liquid crystal displays. In order to overcome the viewing angle problem of large-size liquid crystal displays, the wide viewing angle technology of liquid crystal displays must constantly improve and break through. Polymer Stabilized Vertically Aligned (PSVA) is one of the wide viewing angle technologies currently widely used in liquid crystal displays.

However, for the PSVA type liquid crystal panel, since the optical path difference of the liquid crystal is larger than the front view direction in the side view direction, washout may occur in side view; and as the angle of view increases, the washout phenomenon becomes more serious.

SUMMARY OF THE DISCLOSURE

In order to solve the above problems in the prior art, the disclosure provides a pixel matrix driving device and a display device.

An embodiment of the disclosure provides a pixel matrix driving device including a pixel matrix, a timing controller, and a driving circuit; wherein the pixel matrix includes a plurality of sub-pixels, an i-th column of sub-pixels in the plurality of sub-pixels and an (i+1)-th column of sub-pixels in the plurality of sub-pixels have different polarity inversion positions;

wherein the timing controller is configured for obtaining an initial pixel value, and obtaining a first grayscale value and a second grayscale value according to the initial pixel value; and wherein the driving circuit is configured for obtaining a first driving voltage according to the first grayscale value, obtaining a second driving voltage according to the second grayscale value, and applying the first driving voltage and the second driving voltage into the pixel matrix.

In a specific embodiment, the timing controller is configured for obtaining the initial pixel value of each of the plurality of sub-pixels, and converting the initial pixel value of each of the plurality of sub-pixels into the first grayscale value and the second grayscale value according to a predetermined method.

In a specific embodiment, the driving circuit includes a data driver and a scan driver;

the data driver is configured for applying voltages to the pixel matrix in a frame by a manner of the first driving voltage and the second driving voltage being applied alternately as per a first set interval along a data line direction; and the data driver is further configured for applying voltages to the pixel matrix in the frame by a manner of the first driving voltage and the second driving voltage being applied alternately as per a second set interval along a scan line direction.

In a specific embodiment, a polarity of a j-th sub-pixel in the i-th column of sub-pixels is opposite to a polarity of a (j+N)-th sub-pixel in the i-th column of sub-pixels, where $N \geq 4$.

In a specific embodiment, the first driving voltage is smaller than the second driving voltage, and voltages respectively applied onto a j-th sub-pixel and a (j+N)-th sub-pixel in the i-th column of sub-pixels both are the first driving voltage.

In a specific embodiment, an arrangement of polarities of the i-th column is same as an arrangement of polarities of a (i+M)-th column of sub-pixels, where M represents a cycle of polarity inversion position.

Another embodiment of the disclosure provides a pixel matrix, including a plurality of pixel groups, and each of the pixel groups including a plurality of sub-pixels; wherein colors of adjacent n number of sub-pixels of each row of sub-pixels in the plurality of sub-pixels are different from one another, two sub-pixels arranged in a diagonal direction and respectively located in adjacent two rows for one of the plurality of pixel groups have a same color but different voltage applying modes, and n is an integer greater than 1.

In a specific embodiment, the pixel matrix driving device further includes a timing controller and a driving circuit; wherein the timing controller is configured for obtaining an initial pixel value, and obtaining a first grayscale value and a second grayscale value according to the initial pixel value; and wherein the driving circuit is configured for obtaining a first driving voltage according to the first grayscale value, obtaining a second driving voltage according to the second grayscale value, and sequentially applying the first driving voltage and the second driving voltage onto the two sub-pixels arranged in the diagonal direction and respectively located in the adjacent two rows for the one of the plurality of pixel groups.

In a specific embodiment, the driving circuit includes a data driver, and the data driver is configured for applying voltages to the plurality of pixel groups in a frame by a manner of the first driving voltage and the second driving voltage being applied alternately as per a first set interval along a data line direction.

In a specific embodiment, an arrangement of polarities of an i-th row of sub-pixels in the pixel matrix are opposite to an arrangement of polarities of an (i+12N)-th row of sub-pixels in the pixel matrix, where i and N each are an integer greater than zero.

In a specific embodiment, a polarity of an f-th sub-pixel in a j-th column of sub-pixels in the pixel matrix is opposite to a polarity of an (f+12N)-th sub-pixel in the j-th column of sub-pixels, where j and f each are an integer greater than zero.

In a specific embodiment, the second driving voltage is smaller than the first driving voltage, and voltages respectively applied onto the f-th sub-pixel and the (f+12N)-th sub-pixel in the j-th column of sub-pixels both are the second driving voltage.

In a specific embodiment, voltage applying modes of adjacent two of the plurality of pixel groups are reversed.

In a specific embodiment, an e-th column of sub-pixels and an (e+1)-th column of sub-pixels in the pixel matrix have different polarity inversion positions, where e is an integer greater than 0.

An embodiment of the disclosure further provides a display device including the pixel matrix driving device of any of the above embodiments.

Compared with the prior art, the disclosure has the following beneficial effects:

in one aspect, the polarity inversion positions of the adjacent two columns of the pixel matrix of the disclosure are different, and alternately applying a voltage to the sub-pixel with a first applying voltage or a second applying voltage in a row of sub-pixels and a column of sub-pixels, not only the phenomenon of horizontal equidistant horizontal stripes can be improved; at the same time, according to the above manner, the washout phenomenon of the display panel when viewed from the side can be improved, so that both the front view and the side view have good display quality;

on the other hand, in the pixel matrix driving device of the disclosure, the colors of adjacent n sub-pixels in each row of the pixel matrix are different from each other, and the color of the two sub-pixels disposed along the diagonal direction of the adjacent two rows in each pixel group is the same, at the same time, the two sub-pixels are configured with different applying voltages, thereby improving the washout phenomenon that occurs in side view.

BRIEF DESCRIPTION OF THE DRAWINGS

In order to more clearly illustrate the technical solutions of the embodiments of the disclosure, the drawings used in the description of the embodiments will be briefly described below. Obviously, the drawings in the following description are only some embodiments of the disclosure, and those skilled in the art can obtain other drawings according to the drawings without any creative work.

FIG. 1 is a schematic diagram of a pixel matrix driving device according to a first embodiment of the disclosure.

FIG. 2 is a schematic diagram of another pixel matrix driving device according to the first embodiment of the disclosure.

FIG. 8 is a schematic structural view of still another pixel matrix according to the second embodiment of the disclosure.

FIG. 9 is a schematic structural view of still another pixel matrix according to the second embodiment of the disclosure.

DETAILED DESCRIPTION OF EMBODIMENTS

The technical solutions in the embodiments of the disclosure are clearly and completely described in the following with reference to the accompanying drawings in the embodiments of the disclosure. It is obvious that the described embodiments are only a part of the embodiments of the disclosure, but not all embodiments. All other embodiments obtained by those skilled in the art based on the embodiments of the disclosure without creative efforts are within the scope of the disclosure.

It should be noted that when an element is referred to as "connected" to another element, it can be directly connected to the other element or the central element. The terms "vertical", "horizontal", "left", "right", and the like, as used herein, are for illustrative purposes only and are not intended to be the only embodiment.

Embodiment 1

Figure 3:
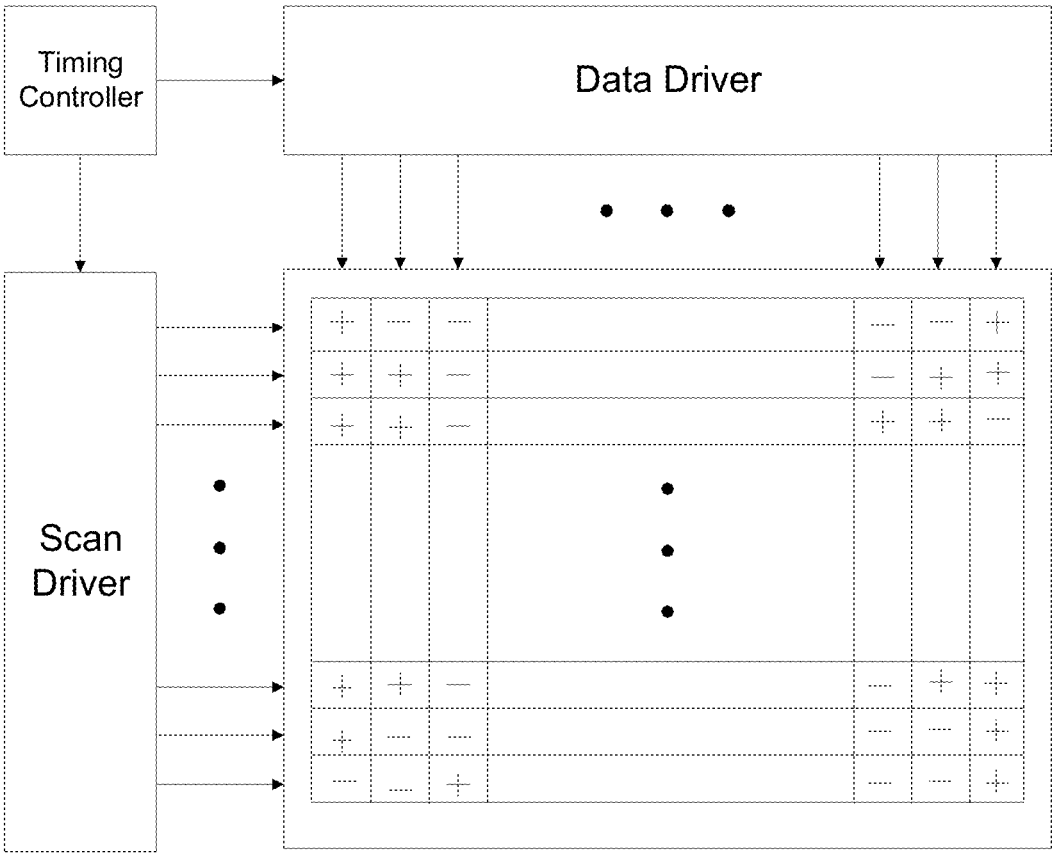
FIG. 3 is a schematic diagram of still another pixel matrix driving device according to the first embodiment of the disclosure.

Referring to FIG. 1, FIG. 2 and FIG. 3, FIG. 1 is a schematic diagram of a pixel matrix driving device according to a first embodiment of the disclosure. The pixel matrix driving device provided by this embodiment includes a pixel matrix, a timing controller and a driving circuit (see FIG. 3). The pixel matrix includes a plurality of sub-pixels, and the i-th column sub-pixel and the (i+1)-th column sub-pixel have different polarity inversion positions (see FIG. 1).

The timing controller is configured to obtain an initial pixel value, and obtain a first grayscale value and a second grayscale value according to the initial pixel value.

The driving circuit is configured to obtain a first applying voltage according to the first grayscale value, obtain a second applying voltage according to the second grayscale value, and apply the first applying voltage and the second applying voltage into the pixel matrix.

The polarity inversion positions of the adjacent two columns of the pixel matrix of the disclosure are different, and in a row of sub-pixels and a column of sub-pixels alternately apply a voltage to the sub-pixel with a first applying voltage or a second applying voltage (see FIG. 2), thereby improving the phenomenon of horizontal equidistant horizontal stripes; at the same time, according to the above manner, the washout phenomenon of the display panel when viewed from the side can be improved, so that both the front view and the side view have good display quality.

Specifically, the pixel matrix driving device includes a plurality of column data lines and a plurality of row scan lines, and the plurality of column data lines are parallel to each other, and the plurality of row scan lines are parallel to each other, the plurality of column data lines and the plurality of row scan lines are vertically arranged to intersect each other, and the plurality of column data lines and the plurality of column scan lines intersect to form X rows and Y columns of sub-pixels arranged in a matrix, and the X rows and Y columns of sub-pixels are the pixel matrix.

Specifically, the i-th column sub-pixel and the (i+1)-th column sub-pixel have different polarity inversion positions, where i is a positive integer and $0<i<X$.

Further, the polarity inversion position refers to a position at which the polarity of the sub-pixel changes in any one of the sub-pixels. For example, the first sub-pixel to the a-th sub-pixel of the i-th column sub-pixel are all positive polarity, that is, the polarity is +, and the (a+1)-th sub-pixel is negative polarity, that is, the polarity is −, then, the position of the (a+1)-th sub-pixel of the i-th column sub-pixel is the position where the polarity changes. Each column of sub-pixels is connected to one data line, and each row of sub-pixels is connected to one scan line.

For example, please refer to FIG. 1 again. FIG. 1 is a pixel matrix of 18 rows and 20 columns. The polarity inversion positions of any two adjacent sub-pixels in FIG. 1 are different. For example, the polarity inversion position corresponding to the first column sub-pixel D1 occurs at a position corresponding to the sub-pixel of the second row sub-pixel G2, and the polarity of the sub-pixel is negative polarity. The polarity of the sub-pixel corresponding to the sub-pixel corresponding to the second row sub-pixel G2 to the 17-th row sub-pixel G17 is negative, and the polarity of the sub-pixel corresponding to the 18-th row sub-pixel G18 is reversed and becomes positive polarity; on the other hand, the polarity inversion position of the second column sub-pixel D2 occurs at a position corresponding to the 9th row sub-pixel G9.

In this embodiment, the polarity inversion positions of the adjacent two columns of sub-pixels are different, which can slow down the delay effect of the RC, thereby reducing the horizontal equidistant horizontal stripes and improving the display quality of the display panel. At the same time, by using the polarity inversion driving with N≥4, the power consumption and temperature generated by the driving can be reduced, the display quality of the display panel can be improved, and the service life of the display panel can be improved.

In a specific embodiment, the timing controller is configured to obtain an initial pixel value, form a first grayscale value and a second grayscale value according to the initial pixel value, cause the first grayscale value to be different from the pixel grayscale of the second grayscale value, generate a first applying voltage according to the first grayscale value, and generate a second applying voltage according to the second grayscale value.

Specifically, the timing controller is specifically configured to obtain an initial pixel value of each sub-pixel, and convert the initial pixel value of each sub-pixel into a first grayscale value or a second grayscale value according to a preset rule. The preset rule converts the initial pixel value into a first grayscale value or a second grayscale value according to an applying voltage applied to each sub-pixel. That is, when the voltage applied by the sub-pixel is the first applying voltage, the initial pixel value of the sub-pixel is converted into the first grayscale value according to the preset rule. When the voltage applied by the sub-pixel is the second applying voltage, the initial pixel value of the sub-pixel is converted into the second grayscale value according to the preset rule, and the converted grayscale values are transmitted to the data driver and the scan driver (as shown in FIG. 3).

Further, after determining the rule for applying a voltage for each sub-pixel position according to the embodiment, the timing controller adjusts the initial pixel value of the sub-pixel position to a low grayscale value or a high grayscale value. That is, the low grayscale value corresponds to the first grayscale value, the high grayscale value corresponds to the second grayscale value, and the adjusted grayscale value is sent to the data driver and the scan driver. The data driver and the scan driver output corresponding voltages according to the grayscale value. That is, the first applying voltage is output to the corresponding sub-pixel position according to the first grayscale value, and the second applying voltage is output according to the second grayscale value to the corresponding sub-pixel position.

For example, referring to FIG. 2, for the first column sub-pixel D1, the initial pixel value of the corresponding sub-pixel in the second row sub-pixel G2 is 120 gray scale. According to FIG. 2, the applying voltage corresponding to the sub-pixel is the first applying voltage, that is, the low grayscale value should be output. After calculation, the first grayscale value is obtained according to the initial pixel value of the sub-pixel, and if the first grayscale value is 110, the sub-pixel corresponds to output 110 grayscale. The data driver and the scan driver receive the first grayscale value of the sub-pixel, and correspondingly output the first applying voltage to the sub-pixel according to the first grayscale value. Meanwhile, for the first column of sub-pixels D1, the initial pixel value of the corresponding sub-pixel in the third row of sub-pixels G3 is 120 grayscale, according to FIG. 2, the applying voltage corresponding to the sub-pixel is the second applying voltage, that is, the high grayscale value should be output. After calculation, the second grayscale value is obtained according to the initial pixel value of the sub-pixel, and if the second grayscale value is 130, the sub-pixel corresponds to output 130 grayscale. The data driver and the scan driver receive the second grayscale value of the sub-pixel, and correspondingly output the second applying voltage to the sub-pixel according to the second grayscale value.

Wherein, the first grayscale value is considered to be a low grayscale value, and the second grayscale value is considered to be a high grayscale value, correspondingly, the magnitude of the voltage input to the sub-pixel is determined by the grayscale, and the low grayscale voltage corresponding to the low grayscale value is generated, that is, the first applying voltage; a high gray scale voltage corresponding to a high gray scale value, that is, a second applying voltage. It is worth mentioning that the above high grayscale value and low grayscale value represent the relative values of the grayscale sizes of the two groups, and the magnitude of the value is not separately limited.

In this embodiment, the first grayscale value and the second grayscale value are obtained according to initial pixel values of the sub-pixels, the grayscale data corresponding to the first grayscale value and the second grayscale value are different, and the voltage is applied according to the first grayscale value and the second grayscale value corresponding to each sub-pixel. That is, the voltage is applied to the pixel matrix alternately with the first applying voltage and the second applying voltage, and the polarity inversion positions of the adjacent two columns of the pixel matrix of the embodiment are different. In the above manner, the voltage applied to the sub-pixels can be further prevented from being caused by the simultaneous polarity inversion of the same row of sub-pixels, and the occurrence of crosstalk and bright and dark lines is further improved, and the phenomenon of horizontal equidistant horizontal stripes is further improved; at the same time, according to the above manner, the washout phenomenon of the display panel when viewed from the side can be improved, so that both the front view and the side view have good display quality.

In a specific embodiment, the driving circuit includes a data driver and a scan driver (see FIG. 3); the data driver is configured to alternately apply a voltage to the pixel matrix with a first applying voltage or a second applying voltage in a direction of a data line in a frame according to a first set interval; the data driver is configured to alternately apply a voltage to the pixel matrix with a first applying voltage or a second applying voltage in a direction of a scan line in a frame according to a second set interval.

The data driver is configured to provide a data signal for the corresponding sub-pixel driving circuit, and the scan driver is configured to provide a scanning signal for the corresponding sub-pixel driving circuit.

For more convenient description, each sub-pixel is marked, and the n-th row and the m-th column sub-pixel is recorded as $A_{nm}$, for example, the first row and the first column of sub-pixels is $A_{11}$.

Specifically, within a frame, for a column of sub-pixels, for example, the n-th column of sub-pixels, in the direction of the data line, from the sub-pixel $A_{1n}$ to the sub-pixel $A_{Xn}$, are alternately applied to the corresponding sub-pixel by the first applying voltage or the second applying voltage according to the first set interval, if the first set interval is two sub-pixels, the voltage applied to the sub-pixel is converted from the first applying voltage to the second applying voltage or from the second applying voltage to the first applying voltage every two sub-pixels, if the voltage applied to the sub-pixel $A_{1n}$ and the sub-pixel $A_{2n}$ is the first applying voltage, the voltage applied to the sub-pixel $A_{3n}$ and the sub-pixel $A_{4n}$ is the second applying voltage, and the voltage applied to the sub-pixel $A_{5n}$ and the sub-pixel $A_{6n}$ is the first applying voltage, and so on.

Specifically, within a frame, for a certain row of sub-pixels, for example, the m-th row of sub-pixels are applied from the sub-pixel $A_{m1}$ to the sub-pixel $A_{mY}$ in the scan line direction, and are alternately applied with the first applying voltage or the second applying voltage to the corresponding sub-pixels according to the second set interval. if the second set interval is every three sub-pixels, the voltage applied to the sub-pixel is converted from the first applying voltage to the second applying voltage or from the second applying voltage to the first applying voltage every three sub-pixels, if the voltage applied to the sub-pixel $A_{m1}$ and the sub-pixel $A_{m3}$ is the first applying voltage, the voltage applied to the sub-pixel $A_{m4}$ and the sub-pixel $A_{m6}$ is the second applying voltage, and the voltage applied to the sub-pixel $A_{m7}$ and the sub-pixel $A_{m9}$ is the first applying voltage, and so on.

For example, see FIG. 2, in a frame, along the data line, when the first set interval is every other sub-pixel, for the first column of sub-pixels, the scan line G1 is connected to the sub-pixel $A_{11}$, and the voltage corresponding to the sub-pixel $A_{11}$ is the second applying voltage; the scan line G2 is connected to the sub-pixel $A_{21}$, and the voltage corresponding to the sub-pixel $A_{21}$ is the first applying voltage; the scan line G3 is connected to the sub-pixel $A_{31}$, and the voltage corresponding to the sub-pixel $A_{31}$ is the second applying voltage; the scan line G4 is connected to the sub-pixel $A_{41}$, and the voltage corresponding to the sub-pixel $A_{41}$ is the first applying voltage; the scan line G5 is connected to the sub-pixel $A_{51}$, and the voltage corresponding to the sub-pixel $A_{51}$ is the second applying voltage; the scan line G6 is connected to the sub-pixel $A_{61}$, and the voltage corresponding to the sub-pixel $A_{61}$ is the first applying voltage, and so on. In the direction of the data line, every other sub-pixel, alternating with the first applying voltage or the second applying voltage corresponding to the applying voltage to the sub-pixel; meanwhile, in the scan line direction, when the second set interval is every other sub-pixel, for the first row of sub-pixels, the data line D1 is connected to the sub-pixel $A_{11}$, and the voltage corresponding to the sub-pixel $A_{11}$ is the second applying voltage; the data line D2 is connected to the sub-pixel $A_{12}$, and the voltage corresponding to the sub-pixel $A_{12}$ is the first applying voltage; the data line D3 is connected to the sub-pixel $A_{13}$, and the voltage corresponding to the sub-pixel $A_{13}$ is the second applying voltage; the data line D4 is connected to the sub-pixel $A_{14}$, and the voltage corresponding to the sub-pixel $A_{14}$ is the first applying voltage; the data line D5 is connected to the sub-pixel $A_{15}$, and the voltage corresponding to the sub-pixel $A_{15}$ is the second applying voltage; the data line D6 is connected to the sub-pixel $A_{16}$, and the voltage corresponding to the sub-pixel $A_{16}$ is the first applying voltage; and so on. In the direction of the scan line, every other sub-pixel, the first driving voltage or the second driving voltage is alternately applied to the sub-pixel.

In this embodiment, the first set interval and the second set interval are set according to actual needs, which is not specifically limited in this embodiment.

In a specific embodiment, the polarity of the j-th sub-pixel of the sub-pixels in the i-th column is opposite to the polarity of the (j+N)-th sub-pixel, wherein N≥4.

Specifically, the polarity of the j-th sub-pixel of the sub-pixels in the i-th column is opposite to the polarity of the (j+N)-th sub-pixel, and N is a period in which the polarity of each column sub-pixel is inverted. For example, referring to FIG. 1, when i takes 1, j takes 1, and 1 takes N, the polarities of the second sub-pixel to the 17-th sub-pixel of the sub-pixels in the first column are negative. On the other hand, the 18-th sub-pixel of the sub-pixels in the first column has opposite polarities and is positive polarity.

In a specific embodiment, the first applying voltage is less than the second applying voltage, and the applying voltages of the j-th sub-pixel and the (j+N)-th sub-pixel of the sub-pixels in the i-th column are both the first applying voltage.

Specifically, for a column of sub-pixels, an applying voltage of a sub-pixel in which a polarity inversion position occurs corresponds to a first applying voltage, for example, see FIG. 1 and FIG. 2, when i takes 1, j takes 1, and N takes 16, for the first column of sub-pixels, the position where the polarity is reversed is the second sub-pixel and the 18-th sub-pixel; accordingly, the voltages applied to the second sub-pixel and the 18-th sub-pixel are both the first applying voltage.

In this embodiment, the polarity inversion position between adjacent two columns of sub-pixels is shifted, and the first applying voltage is applied on the sub-pixel in which the polarity inversion position occurs. The above method reduces the problem of insufficient pixel charging caused by the Resistance Capacitance delay (RC delay) effect, thereby slowing down the phenomenon of horizontal equidistant horizontal stripes on the liquid crystal display panel, and improving the display quality of the liquid crystal display panel; at the same time, it is possible to further improve the washout phenomenon of the display panel when viewed from the side.

In this embodiment, the polarity inversion position is matched with the sub-pixel configured with the first applying voltage, although the brightness of the original sub-pixel is lowered, but the observer does not easily see the influence of the pixel polarity conversion, if the polarity inversion position is matched with the sub-pixel configured with the second applying voltage, and the adjacent sub-pixels configured with the first applying voltage form a cluster dark point, the display screen may have an obvious dot phenomenon. Therefore, the polarity inversion position is matched with the sub-pixel configured with the first applying voltage. It is possible to avoid a phenomenon in which a partial dark spot block formed when a polarity change position is matched with a sub-pixel configured with a second applying voltage, so that the overall display effect is poor.

In a specific embodiment, the polarities of the sub-pixels in the i-th column are the same as the polarities of the sub-pixels in the (i+M)-th column, where M is a positive integer and M≥4.

Specifically, the polarities of all the sub-pixels in the i-th column sub-pixel are the same as the polarities of all the sub-pixels in the corresponding position in the (i+M)-th column sub-pixel, that is, the cycle period of the polarity of each column of sub-pixels in the X-row Y-column sub-pixel is M columns of sub-pixels. For example, referring to FIG. 1, where M is 16, the polarities of the sub-pixels in the first column are the same as the polarities of the sub-pixels in the 17-th column.

In this embodiment, the polarities of the sub-pixels of some columns in the pixel matrix are set to be the same according to a certain cycle period. At the same time, the first applying voltage is applied to the sub-pixel in which the polarity inversion position occurs, and the problem of insufficient pixel charging due to the RC delay effect can be further reduced by the above manner. Thereby, the phenomenon of horizontal equidistant horizontal stripes on the display panel is further slowed down, and at the same time, the whitish phenomenon is further improved, so that the display is uniform and the display effect is improved.

Specifically, the timing controller is specifically configured to obtain an initial pixel value of each sub-pixel, and convert the initial pixel value of each sub-pixel into a first grayscale value or a second grayscale value according to a preset rule. The preset rule converts the initial pixel value into a first grayscale value or a second grayscale value according to an applying voltage applied to each sub-pixel. That is, when the voltage applied by the sub-pixel is the first applying voltage, the initial pixel value of the sub-pixel is converted into the first grayscale value according to a preset rule; when the voltage applied by the sub-pixel is the second applying voltage, the initial pixel value of the sub-pixel is converted into the second grayscale value according to a preset rule, and the converted grayscale value is transmitted to the data driver.

An embodiment of the disclosure further provides a pixel matrix driving method, where a pixel matrix includes a plurality of sub-pixels, and the i-th column sub-pixel and the (i+1)-th column sub-pixel have different polarity inversion positions.

The pixel matrix driving method includes the following steps.

Step 1, Obtaining an initial pixel value, and obtaining a first grayscale value and a second grayscale value according to the initial pixel value.

Specifically, initial pixel values of each sub-pixel are obtained, and initial pixel values of each sub-pixel are converted into a first grayscale value and a second grayscale value according to a preset rule.

An initial pixel value of each sub-pixel is obtained, and an initial pixel value of each sub-pixel is converted into a first grayscale value or a second grayscale value according to a preset rule. The preset rule converts the initial pixel value into a first grayscale value or a second grayscale value according to an applying voltage applied to each sub-pixel. That is, when the voltage applied by the sub-pixel is the first applying voltage, the initial pixel value of the sub-pixel is converted into the first grayscale value according to a preset rule; when the voltage applied by the sub-pixel is the second applying voltage, the initial pixel value of the sub-pixel is converted into the second grayscale value according to a preset rule. The grayscale values of each sub-pixel conversion are transmitted to the data driver and the scan driver.

Step 2, Obtaining a first applying voltage according to the first grayscale value, obtaining a second applying voltage according to the second grayscale value, and applying the first applying voltage and the second applying voltage into the pixel matrix.

Specifically, in a frame, along the data line direction, according to the first set interval, alternately apply the voltage to the pixel matrix with the first applying voltage or the second applying voltage; in a frame, along the scan line direction, according to the second set interval, alternately apply the voltage to the pixel matrix with the first applying voltage or the second applying voltage.

After determining the rule for applying the voltage of each sub-pixel position according to the embodiment, the initial pixel value of the sub-pixel position is correspondingly adjusted to a low grayscale value or a high grayscale value. That is, the low grayscale value corresponds to the first grayscale value, the high grayscale value corresponds to the second grayscale value, and the adjusted grayscale value is sent to the data driver and the scan driver, and applying the voltage to the pixel matrix alternately with the first applying voltage or the second applying voltage in a direction of the data line according to the first set interval; in the direction of the scan line, the voltage is applied to the pixel matrix alternately with the first applying voltage or the second applying voltage according to the second set interval.

The pixel matrix driving method of the embodiment causes the polarity inversion positions between adjacent two columns of sub-pixels to be staggered, and the first applying voltage is applied on the sub-pixels in which the polarity inversion position occurs, the above method reduces the problem of insufficient pixel charging caused by the RC delay effect, thereby slowing down the phenomenon of horizontal equidistant horizontal stripes on the liquid crystal display panel, and improving the display quality of the liquid crystal display panel; at the same time, it is possible to further improve the washout phenomenon of the display panel when viewed from the side.

The embodiment of the disclosure further provides a display, which is composed of the pixel matrix driving device of the above embodiment.

The polarity inversion positions of the adjacent two columns of the pixel matrix of the embodiment are different, and in a certain row of sub-pixels and a column of sub-pixels alternately apply the voltage to the sub-pixel with the first applying voltage or the second applying voltage, thereby improving the phenomenon of horizontal equidistant horizontal stripes; at the same time, according to the above manner, the washout phenomenon of the display panel when viewed from the side can be improved, and at the same time, the high transmittance can be maintained, the display is uniform, and the display effect is improved.

Embodiment 2

Figure 5:
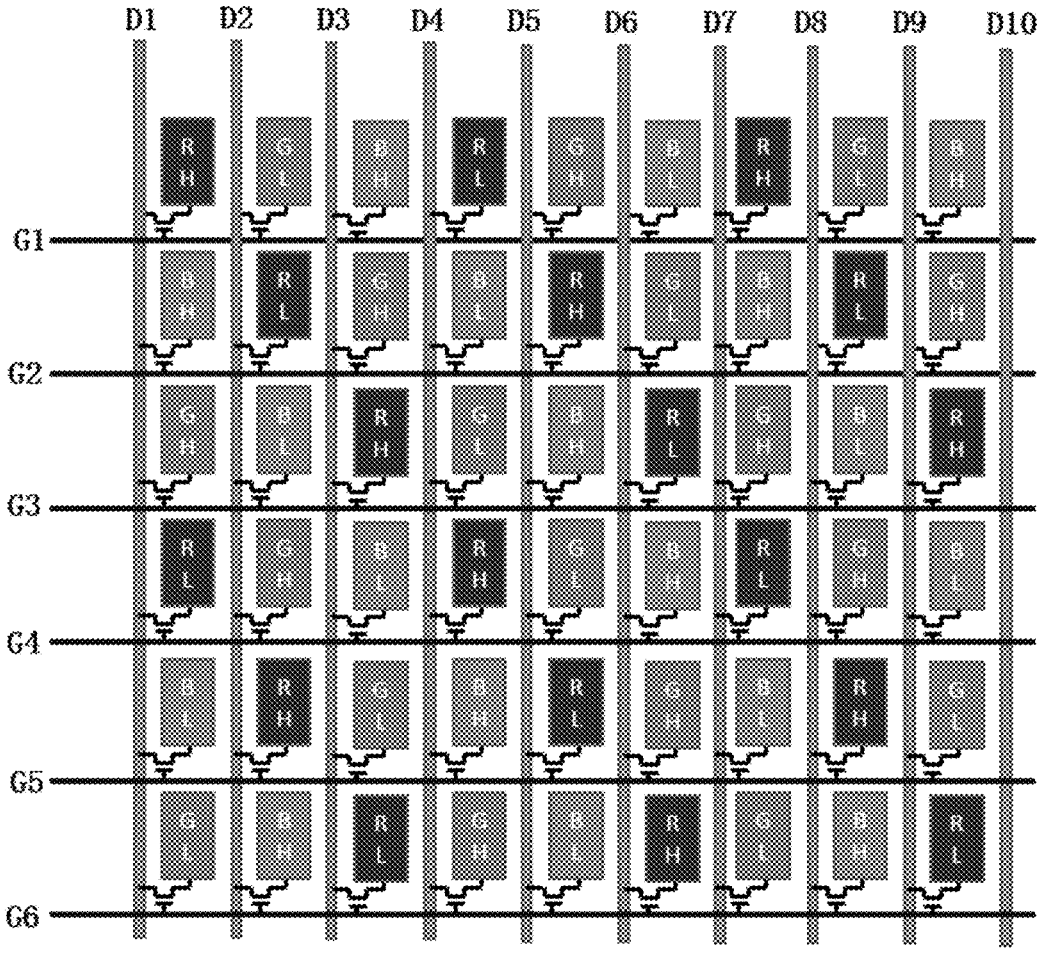
FIG. 5 is a schematic structural view of a pixel matrix according to a second embodiment of the disclosure.

Referring to FIG. 5, FIG. 5 is a schematic structural view of a pixel matrix according to a second embodiment of the disclosure. An embodiment of the disclosure provides a pixel matrix driving device, where the pixel matrix driving device includes a pixel matrix, the pixel matrix includes a plurality of pixel groups, and each of the pixel groups includes a plurality of sub-pixels. Wherein, the colors of adjacent n sub-pixels of each row of sub-pixels are different from each other, the two sub-pixels arranged in the diagonal direction of the adjacent two rows in the pixel group have the same color and different applying voltage modes, and n is an integer greater than 1.

Specifically, the pixel matrix includes a plurality of pixel groups, and each pixel group includes several sub-pixels. Further, the pixel matrix includes $X_1$ rows and Y columns of sub-pixels, and each pixel group includes $X_2$ rows and Y columns of sub-pixels, wherein $X_1$, $X_2$, and Y are positive integers greater than 0, and $0<X_2 \leq X_1$. Meanwhile, the colors of adjacent n sub-pixels in each row of sub-pixels in the pixel matrix are different from each other, for example, n is 3, referring again to FIG. 5, the color of the first sub-pixel of the first row of sub-pixels corresponding to the scan line G1 is red (R), the color of the second sub-pixel is green (G), and the color of the third sub-pixel is blue (B), and so on. At the same time, for each pixel group, the two sub-pixels arranged in the diagonal direction of the adjacent two rows of sub-pixels have the same color, that is, both red, blue or green at the same time; the applying voltages of the two sub-pixels are different from each other, that is, the magnitudes of the applying voltages configured by the two sub-pixels are different from each other.

Where the diagonal direction is set in a matrix of pixels, the direction of the diagonal of the setting is fixed, which is two sub-pixels on the diagonal line of two adjacent sub-pixels in the adjacent two rows of sub-pixels. For example, the direction may be from the first sub-pixel of the first row to the second sub-pixel of the second row, or the direction may be from the second sub-pixel of the first row to the first sub-pixel of the second row.

In the pixel matrix of the embodiment of the disclosure, the colors of the adjacent n sub-pixels in each row are different from each other, and the colors of the two sub-pixels disposed along the diagonal direction of the adjacent two rows in each pixel group are the same. At the same time, the two sub-pixels are configured with different applying voltages, thereby improving the washout phenomenon that occurs in side view.

Figure 4:
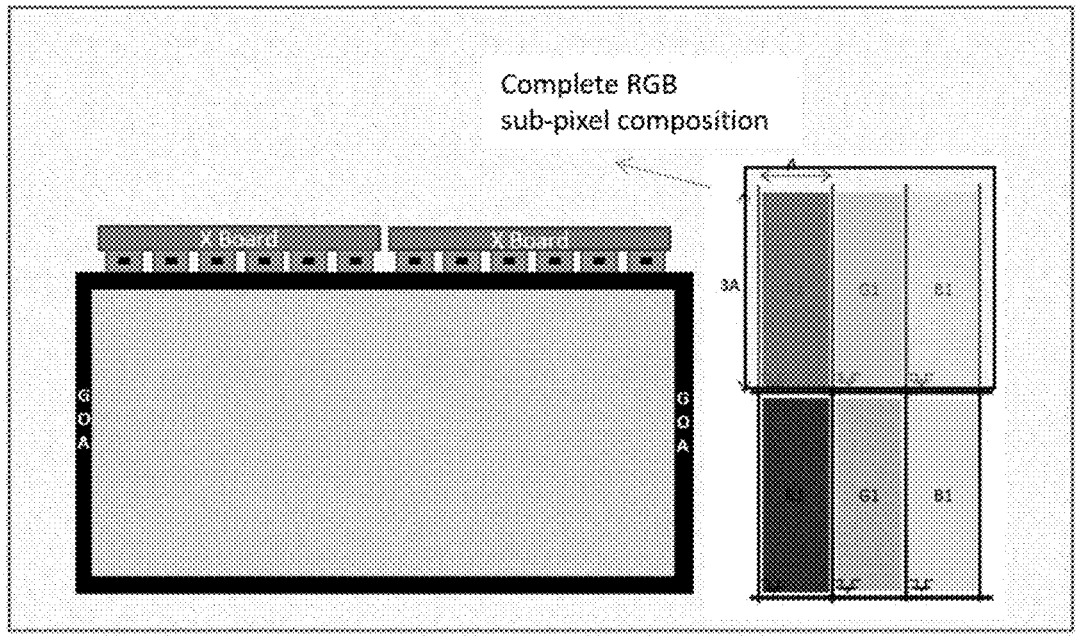
FIG. 4 (Prior Art)
FIG. 4 is a schematic structural view of a conventional UD (Ultra High Definition) display panel.
Figure 6:
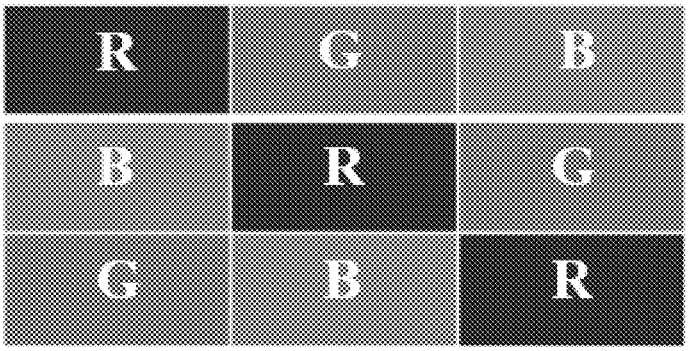
FIG. 6 is a schematic structural view of a pentile arrangement according to the second embodiment of the disclosure.

Preferably, each pixel group includes 3M line sub-pixels, where M is a positive integer greater than 0, for example, see FIG. 6, a pixel group is a structure in which RGB sub-pixels are arranged in a pentile form, and a pixel group arranged in a pentile form is used, and a color of a sub-pixel in which the pixel group is set in a diagonal direction is set to the same color (thus different from the conventional sub-pixel arrangement shown in FIG. 4). At the same time, the magnitudes of the applying voltages of the two sub-pixels are different, so that the washout phenomenon of the display panel when viewed in the side viewing direction can be further improved, thereby improving the display quality of the display panel.

In a specific embodiment, referring to FIG. 3, the pixel matrix driving device further includes a timing controller and a driving circuit, wherein the timing controller is configured to obtain an initial pixel value, and obtain a first grayscale value and a second grayscale value according to the initial pixel value;

the driving circuit is configured to obtain a first applying voltage according to the first grayscale value, and obtain a second applying voltage according to the second grayscale value; the applying voltages of the two sub-pixels arranged in the diagonal direction of the adjacent two rows in the pixel group are sequentially the first applying voltage or the second applying voltage.

Specifically, the timing controller is configured to obtain the initial pixel value, and form a first grayscale value and a second grayscale value according to the initial pixel value, cause the first grayscale value to be different from the pixel grayscale of the second grayscale value, and generate the first applying voltage according to the first grayscale value, and generating the second applying voltage according to the second grayscale value.

The timing controller is specifically configured to obtain the initial pixel value of each sub-pixel, and convert the initial pixel value of each sub-pixel into the first grayscale value or the second grayscale value according to a preset rule. The preset rule converts the initial pixel value into the first grayscale value or the second grayscale value according to the applying voltage applied to each sub-pixel. That is, when the voltage applied by the sub-pixel is the first applying voltage, the initial pixel value of the sub-pixel is converted into the first grayscale value according to the preset rule; when the voltage applied by the sub-pixel is the second applying voltage, the initial pixel value of the sub-pixel is converted into the second grayscale value according to the preset rule, and the converted grayscale values are transmitted to the data driver and the scan driver.

After determining the rule for applying the voltage for each sub-pixel position according to the embodiment, the timing controller adjusts the initial pixel value of the sub-pixel position to a low grayscale value or a high grayscale value, that is, the high grayscale value corresponds to the first grayscale value, the low grayscale value corresponds to the second grayscale value, and the adjusted grayscale value is sent to the driving circuit, the data driver and the scan driver output corresponding voltages according to the grayscale value, that is, the first applying voltage is output to the corresponding sub-pixel position according to the first grayscale value, and the second applying voltage is output according to the second grayscale value to the corresponding sub-pixel position.

Wherein, the first grayscale value is considered to be a low grayscale value, and the second grayscale value is considered to be a high grayscale value, correspondingly, the magnitude of the voltage input to the sub-pixel is determined by the grayscale, and the high grayscale voltage corresponding to the high grayscale value is generated, that is, the first applying voltage; a low grayscale voltage corresponding to a low grayscale value, that is, a second applying voltage, it is worth mentioning that the above high grayscale value and low grayscale value represent the relative values of the grayscale sizes of the two groups, and the magnitude of the value is not separately limited.

Specifically, the driving circuit is configured to provide a signal for the corresponding sub-pixel driving circuit, when the driving circuit obtains the grayscale value corresponding to the subpixel, the corresponding voltage is applied to the sub-pixel according to whether the grayscale value is the first grayscale value or the second grayscale value, the applying voltages of the two sub-pixels arranged in the diagonal direction of the adjacent two rows in each pixel group are sequentially the first applying voltage or the second applying voltage.

Figure 7:
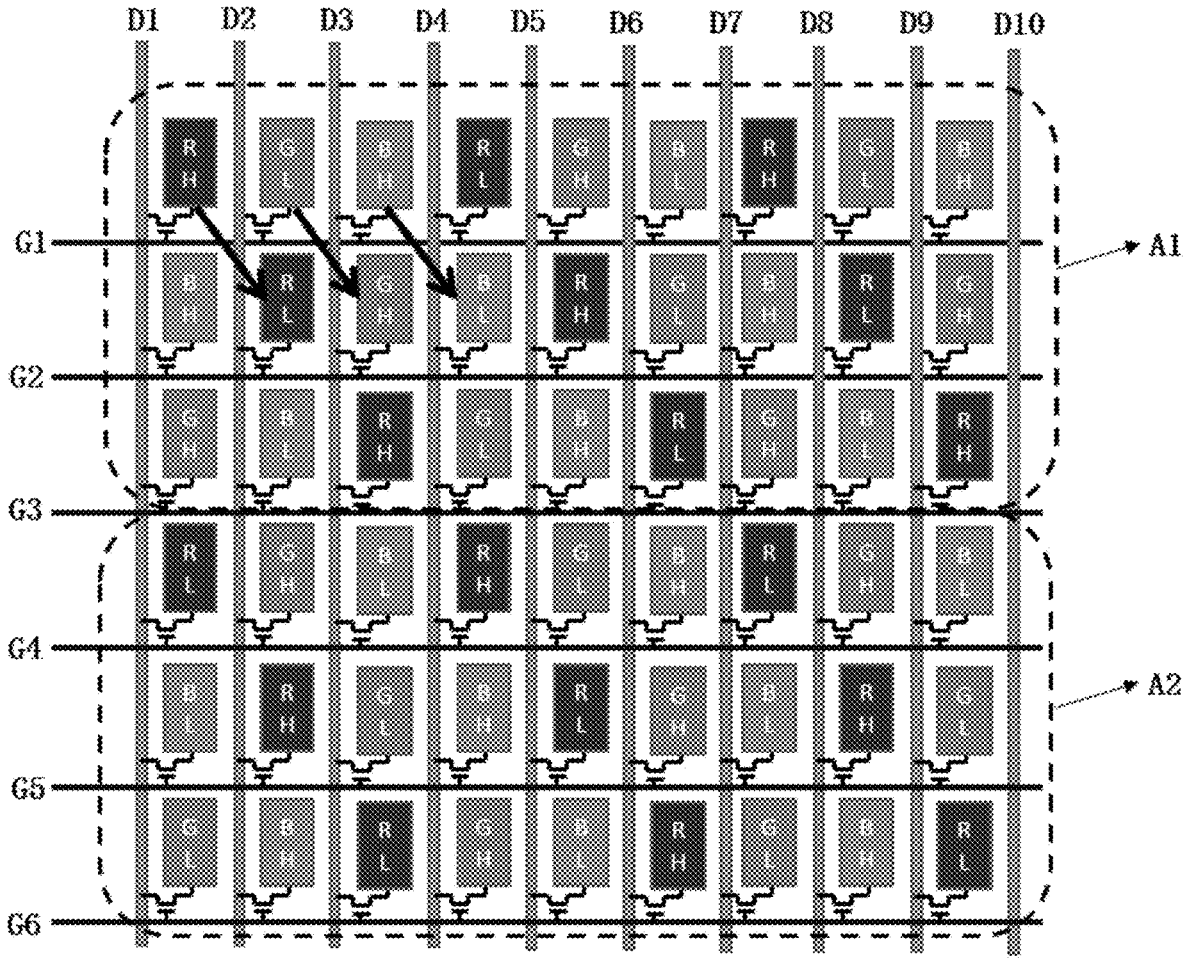
FIG. 7 is a schematic structural view of another pixel matrix according to the second embodiment of the disclosure.

For each pixel group, the voltages applied to the two sub-pixels arranged along the diagonal direction of the adjacent two rows of sub-pixels are sequentially the first applying voltage or the second applying voltage, that is, when one of the two sub-pixels is the first applying voltage, the other applying voltage is the second applying voltage, for example, referring to FIG. 7, the pixel matrix includes two pixel groups, which are a pixel group A1 and a pixel group A2, respectively, and the pixel group A1 and the pixel group A2 each include 3 rows and 9 columns of sub-pixels, wherein, for the pixel group A1, the color of the first sub-pixel of the first row of sub-pixels is red, and the applied voltage is the first applying voltage; the color of the second sub-pixel of the second row of sub-pixels is red, and the applying voltage is the second applying voltage; the color of the third sub-pixel of the third row of sub-pixels is red, and the applying voltage is the second applying voltage, and so on.

In the embodiment of the disclosure, the voltages applied by the two sub-pixels arranged along the set diagonal direction of the adjacent two rows of sub-pixels in one pixel group are sequentially set as the first applying voltage or the second applying voltage, at the same time, for the pixel group, the color of the sub-pixels along the diagonal direction is set to the same color, and the washout phenomenon generated in the side viewing direction can be further improved, thereby improving the display quality.

In a specific embodiment, the driving circuit includes a data driver (see FIG. 3), the data driver is configured to alternately apply the voltage to the pixel group with the first applying voltage or the second applying voltage in a direction of a data line according to a set interval.

The data driver is configured to provide a data signal for the corresponding sub-pixel driving circuit.

In this embodiment, the set interval is set according to actual needs, and is not specifically limited in this embodiment.

For more convenient description, each sub-pixel is marked, and each pixel group is set to include $X_2$ rows and Y columns of sub-pixels, further, the sub-pixels of the N-th row of the M-th column in the pixel group are denoted by $A_{M,N}$, and for example, the sub-pixels of the first row of the first column are denoted as $A_{1,1}$.

Specifically, each pixel group includes X2 rows and Y columns of sub-pixels, and the set interval is K sub-pixels. In one frame, for one pixel group, every K sub-pixels are alternately applied with corresponding first sub-pixels with a first applying voltage or a second applying voltage along the data line direction, that is, within a frame, for a column of sub-pixels in a pixel group, for example, the m-th column sub-pixel is applied from the sub-pixel $A_{1m}$ to the sub-pixel $A_{Ym}$ in the direction of the data line, and is alternately applied to the corresponding sub-pixel by the first applying voltage or the second applying voltage according to the set interval, if the set interval is three sub-pixels, the voltage applied to the sub-pixel is converted from the first applying voltage to the second applying voltage or from the second applying voltage to the first applying voltage every three sub-pixels, if the voltage applied to the sub-pixel $A_{1m}$ to the sub-pixel $A_{3m}$ is the first applying voltage, the voltage applied to the sub-pixel $A_{4m}$ to the sub-pixel $A_{6m}$ is the second applying voltage, the voltage applied to the sub-pixel $A_{7m}$ to the sub-pixel $A_{9m}$ is the first applying voltage, and so on.

For example, referring to FIG. 8, the set interval of the pixel matrix is one sub-pixel. In the scan line direction, for the first row of sub-pixels, the data line D1 is connected to the sub-pixel $A_{11}$, and the voltage corresponding to the sub-pixel $A_{11}$ is the first applying voltage; the data line D2 is connected to the sub-pixel $A_{12}$, and the voltage corresponding to the sub-pixel $A_{12}$ is the second applying voltage; the data line D3 is connected to the sub-pixel $A_{13}$, and the voltage corresponding to the sub-pixel $A_{13}$ is the first applying voltage; the data line D4 is connected to the sub-pixel $A_{14}$, and the voltage corresponding to the sub-pixel $A_{14}$ is the second applying voltage; the data line D5 is connected to the sub-pixel $A_{15}$, and the voltage corresponding to the sub-pixel $A_{15}$ is the first applying voltage; the data line D6 is connected to the sub-pixel $A_{16}$, and the voltage corresponding to the sub-pixel $A_{16}$ is the second applying voltage, and so on. That is, in the direction of the scan line, every other sub-pixel, the first applying voltage or the second applying voltage is alternately applied to the sub-pixel.

According to the above embodiment of the disclosure, by alternately applying the high voltage and the low voltage to the corresponding sub-pixels in the scan line direction, the washout phenomenon in the side viewing direction can be improved, the display effect can be improved, and the display effect can be improved.

In a specific embodiment, the driving circuit further includes a scan driver (see FIG. 3), wherein the scan driver is configured to provide a scan signal for the corresponding sub-pixel driving circuit.

In a specific embodiment, the polarity of the i-th row of sub-pixels of the pixel matrix is opposite to the polarity of the (i+12N)-th row sub-pixel, wherein i and N are integers greater than zero.

Specifically, the polarity of all the sub-pixels in the i-th row sub-pixel is opposite to the polarity of all the sub-pixels in the corresponding position in the (i+12N)-th row sub-pixel, that is, every 12N rows of sub-pixels, the polarity of the pixel matrix is inverted once, for example, referring to FIG. 9, N=1, the polarity of the first row of sub-pixels corresponding to the scan line G1 is +−−++−−++−−++−−, then the polarity of the 13-th line is arranged as −++−−++−−++−−++, and so on.

The conventional polarity inversion of the conventional pixel matrix is the N line polarity inversion method, but this method causes the display panel to have an equidistant horizontal grain problem. In this embodiment, on the basis of the above embodiment, the polarity inversion mode of the 12N line is matched, and in the scan line direction, the high voltage and the low voltage are alternately applied to the corresponding sub-pixels. Thereby, the problem of equidistant horizontal stripes can be effectively improved, and at the same time, the washout phenomenon generated in the side view direction is solved.

In a specific embodiment, the polarity of the f-th sub-pixel of the j-th column sub-pixel of the pixel matrix is opposite to the polarity of the (f+12N)-th sub-pixel, wherein j and f are integers greater than zero.

Specifically, the polarity of the f-th sub-pixel of the j-th column sub-pixel is opposite to the polarity of the (f+12N)-th sub-pixel, and 12N is a period in which the polarity of each column sub-pixel is inverted, that is, for the j-th column sub-pixel, the polarities of the f-th sub-pixel to the (f+12N−1)-th sub-pixel are the same, and the polarity of the (f+12N)-th sub-pixel is opposite to the polarity of the f-th sub-pixel. And the polarity of the (f+12N)-th sub-pixel is the same as the polarity of the (f+24N−1)-th sub-pixel, and so on. For example, referring to FIG. 9, when j is taken as 1, f is taken as 4, and N is taken as 1, the polarities of the fourth sub-pixel to the fifteenth sub-pixel of the first column of sub-pixels are negative (−), and the 16-th sub-pixel of the first column of sub-pixels has opposite polarities and is positive (+).

In a specific embodiment, the second applying voltage is smaller than the first applying voltage, and applying voltages of the f-th sub-pixel and the (f+12N)-th sub-pixel of the j-th column sub-pixel of the pixel matrix are both second applying voltages.

Figure 10:
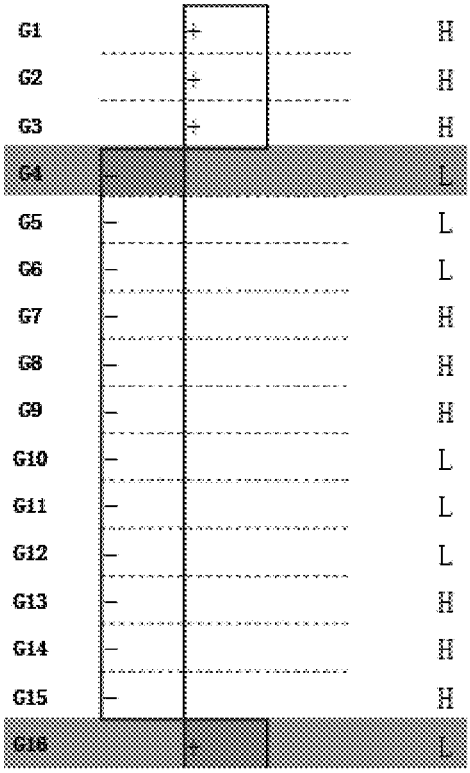
FIG. 10 is a schematic diagram of a voltage applying mode of a sub-pixel according to the second embodiment of the disclosure.

Specifically, for a column of sub-pixels, an applying voltage of a sub-pixel in which a polarity inversion position occurs corresponds to a second applying voltage, for example, see FIG. 10, for the column sub-pixels, the positions at which the polarity inversion occurs are the fourth sub-pixel and the 16-th sub-pixel, and accordingly, the voltages applied to the fourth sub-pixel and the 16-th sub-pixel are both the second applying voltage.

For each column of pixels of the pixel matrix of the embodiment, the second applying voltage is applied on the sub-pixel where the polarity inversion position occurs, that is, the low voltage is applied, in this way, the problem of insufficient pixel charging due to the RC delay effect is reduced, thereby slowing down the horizontal equidistant horizontal stripes on the liquid crystal display panel, at the same time, with the polarity inversion of 12N line, and in the direction of the scan line, by alternately applying high voltage and low voltage to the corresponding sub-pixels, thereby, the problem of equidistant horizontal stripes can be effectively improved, and at the same time, the washout phenomenon generated in the side viewing direction is solved.

In a specific embodiment, the voltage applying modes of adjacent two pixel groups are reversed.

Specifically, the pixel matrix includes $X_1$ rows and Y columns of sub-pixels, and the pixel matrix includes a plurality of pixel groups, and each pixel group includes $X_2$ rows and Y columns of sub-pixels, wherein voltages of adjacent two pixel groups are applied in opposite ways, that is, if the pixel group $A_1$ and the pixel group $A_2$ are two adjacent pixel groups, the voltages of the sub-pixels in the pixel group $A_1$ and the sub-pixels in the corresponding positions in the pixel group $A_2$ are reversed. That is, if the applying voltage of the y-th sub-pixel in the x-th sub-pixel of the pixel group $A_1$ is the first applying voltage, then, the applying voltage of the y-th sub-pixel in the x-th row of sub-pixels in the pixel group A2 is the second applying voltage.

In a specific embodiment, the e-th column sub-pixel and the (e+1)-th column sub-pixel of the pixel matrix have different polarity inversion positions, wherein e is an integer greater than 0.

Specifically, the polarity inversion position refers to a position where the polarity changes in any one of the columns of sub-pixels. For example, the first pixel to the a-th pixel of the pixel unit in the e-th column are all positive polarity, and the (a+1)-th pixel is negative polarity, and the (a+1)-th pixel is a position where the polarity changes.

Specifically, the polarity inversion positions of any two adjacent sub-pixels in the pixel matrix are different, so that the polarity inversion positions are staggered without simultaneously occurring on the same row of sub-pixels. Thereby slowing the horizontal equidistant horizontal stripes on the liquid crystal display panel.

In the pixel matrix of the embodiment of the disclosure, the colors of the two sub-pixels arranged in the diagonal direction of the adjacent two rows in each pixel group are the same, and the voltages of the two sub-pixels are respectively high voltage and low voltage, and the pixel matrix is matched with the polarity inversion mode of 12N line, and the voltage configured by the sub-pixels in the polarity inversion position is set to a low voltage, thereby, not only the washout phenomenon in the side view direction is solved, but also the horizontal equidistant horizontal stripes phenomenon is effectively removed, and the display quality of the liquid crystal display panel is improved.

Embodiment 3

An embodiment of the disclosure further provides a display device, and the display device (see FIG. 3) includes:

a pixel matrix driving device, including a pixel matrix, the pixel matrix includes a plurality of pixel groups, each of the pixel groups includes a plurality of sub-pixels, wherein colors of adjacent n sub-pixels of each row of sub-pixels are different from each other, the two sub-pixels arranged in the diagonal direction of the adjacent two rows in the pixel group have the same color and different applying voltage modes, and n is an integer greater than 1.

In a specific embodiment, the display further includes a timing controller and a driving circuit, wherein the timing controller is configured to obtain an initial pixel value, and obtain a first grayscale value and a second grayscale value according to the initial pixel value;

the driving circuit is configured to obtain a first applying voltage according to the first grayscale value, and obtain a second applying voltage according to the second grayscale value; the applying voltages of the two sub-pixels arranged in the diagonal direction of the adjacent two rows in the pixel group are sequentially the first applying voltage or the second applying voltage.

In a specific embodiment, the driving circuit includes a data driver, wherein the data driver is configured to alternately apply a voltage to the pixel group with the first applying voltage or the second applying voltage in a scan line direction in a frame according to a set interval.

In a specific embodiment, the polarity of the i-th row of sub-pixels of the pixel matrix is opposite to the polarity of the (i+12N)-th row sub-pixel, wherein i and N are integers greater than zero.

In a specific embodiment, the polarity of the f-th sub-pixel of the j-th column sub-pixel of the pixel matrix is opposite to the polarity of the (f+12N)-th sub-pixel, wherein j and f are integers greater than zero.

In a specific embodiment, the second applying voltage is smaller than the first applying voltage, and applying voltages of the f-th sub-pixel and the (f+12N)-th sub-pixel of the j-th column sub-pixel of the pixel matrix are both second applying voltages.

In a specific embodiment, the voltage applying modes of adjacent two pixel groups are reversed.

In a specific embodiment, the e-th column sub-pixel and the (e+1)-th column sub-pixel of the pixel matrix have different polarity inversion positions, wherein e is an integer greater than 0.

In the pixel matrix of the embodiment of the disclosure, the colors of the two sub-pixels arranged in the diagonal direction of the adjacent two rows in each pixel group are the same, and the voltages of the two sub-pixels are respectively high voltage and low voltage, and the pixel matrix is matched with the polarity inversion mode of 12N line, and the voltage configured by the sub-pixels in the polarity inversion position is set to a low voltage, therefore, the washout phenomenon in the side view direction is not only solved, but also the horizontal equidistant horizontal stripes phenomenon can be effectively removed, and the display quality of the liquid crystal display panel is improved.

Finally, it should be noted that the above embodiments are only used to illustrate the technical solutions of the disclosure, and are not limited thereto; although the disclosure has been described in detail with reference to the foregoing embodiments, those skilled in the art should understand that the technical solutions described in the foregoing embodiments may be modified or equivalently substituted for some of the technical features. The modifications and substitutions of the disclosure do not depart from the spirit and scope of the technical solutions of the embodiments of the disclosure.

What is claimed is:

1. A pixel matrix driving device, comprising:

a pixel matrix, comprising a plurality of pixel groups, and each of the pixel groups comprising a plurality of sub-pixels;

wherein colors of adjacent n number of sub-pixels of each row of sub-pixels in the plurality of sub-pixels are different from one another, two sub-pixels arranged in a diagonal direction and respectively located in adjacent two rows for one of the plurality of pixel groups have a same color but different voltage applying modes, and n is an integer greater than 1;

wherein an arrangement of polarities of an i-th row of sub-pixels in the pixel matrix is opposite to an arrangement of polarities of an (i+12N)-th row of sub-pixels in the pixel matrix, where i and N each are an integer greater than zero;

wherein an e-th column of sub-pixels and an (e+1)-th column of sub-pixels in the pixel matrix have different polarity inversion positions being not located in the same row, where e is an integer greater than zero;

wherein a polarity of an f-th sub-pixel in the e-th column of sub-pixels in the pixel matrix is opposite to a polarity of an (f+12N)-th sub-pixel in the e-th column of sub-pixels, a position at which the f-th sub-pixel is located is the polarity inversion position of the e-th column of sub-pixels, polarities of all sub-pixels located between the f-th sub-pixel and the (f+12N)-th sub-pixels and in the e-th column of sub-pixels are the same, and two sub-pixels in the pixel matrix respectively adjacent to the f-th sub-pixel in the e-th column but respectively at different rows have opposite polarities, where f is an integer greater than zero.

2. The pixel matrix driving device according to claim 1, further comprising a timing controller and a driving circuit;

wherein the timing controller is configured for obtaining an initial pixel value, and obtaining a first grayscale value and a second grayscale value according to the initial pixel value; and wherein the driving circuit is configured for obtaining a first driving voltage according to the first grayscale value, obtaining a second driving voltage according to the second grayscale value, and sequentially applying the first driving voltage and the second driving voltage onto the two sub-pixels arranged in the diagonal direction and respectively located in the adjacent two rows for the one of the plurality of pixel groups.

3. The pixel matrix driving device according to claim 2, wherein the driving circuit comprises a data driver, and the data driver is configured for applying voltages to the plurality of pixel groups in a frame by a manner of the first driving voltage and the second driving voltage being applied alternately as per a first set interval along a data line direction.

4. The pixel matrix driving device according to claim 2, wherein the second driving voltage is smaller than the first driving voltage, and voltages respectively applied onto the f-th sub-pixel and the (f+12N)-th sub-pixel in the e-th column of sub-pixels both are the second driving voltage.

5. The pixel matrix driving device according to claim 1, wherein voltage applying modes of adjacent two of the plurality of pixel groups are reversed.

* * * * *